US010267504B2

(12) United States Patent
Frederiksen

(10) Patent No.: US 10,267,504 B2
(45) Date of Patent: Apr. 23, 2019

(54) ELECTRICAL SUPPLY MODULE FOR FLEXIBLE COUPLING

(71) Applicant: LED IBOND INTERNATIONAL APS, Kgs. Lyngby (DK)

(72) Inventor: Lars Frederiksen, Gentofte (DK)

(73) Assignee: LED IBOND INTERNATIONAL APS, Kgs. Lyngby (DK)

( * ) Notice: Subject to any disclaimer, the term of this patent is extended or adjusted under 35 U.S.C. 154(b) by 0 days.

(21) Appl. No.: 16/069,400

(22) PCT Filed: Oct. 31, 2016

(86) PCT No.: PCT/DK2016/050349

§ 371 (c)(1),
(2) Date: Jul. 11, 2018

(87) PCT Pub. No.: WO2017/121430

PCT Pub. Date: Jul. 20, 2017

(65) Prior Publication Data

US 2019/0003692 A1 Jan. 3, 2019

(30) Foreign Application Priority Data

Jan. 11, 2016 (DK) ..... 2016 70010

(51) Int. Cl.
*F21V 23/02* (2006.01)
*F21V 33/00* (2006.01)
(Continued)

(52) U.S. Cl.
CPC ..... *F21V 23/02* (2013.01); *F21S 8/04* (2013.01); *F21V 21/35* (2013.01); *F21V 33/006* (2013.01);
(Continued)

(58) Field of Classification Search
USPC ..... 439/119
See application file for complete search history.

(56) References Cited

U.S. PATENT DOCUMENTS 6,840,776 B2 * 1/2005 Sørensen ..... H01R 33/94 439/56
7,547,924 B1 * 6/2009 Lin ..... H01L 33/62 257/98
(Continued)

FOREIGN PATENT DOCUMENTS

DE 10 2008 021014 A1 10/2009
EP 2 194 761 A1 6/2010
(Continued)

OTHER PUBLICATIONS

International Search Report (PCT/ISA/210) dated Jan. 2, 2017, by the European Patent Office as the International Searching Authority for International Application No. PCT/DK2016/050349.
(Continued)

*Primary Examiner* — Harshad C Patel
(74) *Attorney, Agent, or Firm* — Buchanan Ingersoll & Rooney P.C.

(57) ABSTRACT

An electrical supply module including: a composite board including an anode layer and a cathode layer of electrically conducting material, which anode layer and cathode layer are separated by an insulator of electrically insulating material, the anode layer and the cathode layer each having a trench extending from a connection surface of the composite board; an adapter for mounting in a hole extending entirely through or partly through the composite board, the adapter including a circuit board carrying an electronic component, the circuit board establishing electrical connection from the anode layer to an anode of the electronic component and electrical connection from the cathode layer to a cathode of the electronic component; and a power supply capable of
(Continued)

providing a constant voltage or a constant current between the anode layer and the cathode layer. An electrical supply system including the electrical supply module and an extension module.

23 Claims, 5 Drawing Sheets

(51) Int. Cl.

| | |
|---|---|
| ***F21S 8/04*** | (2006.01) |
| ***F21V 21/35*** | (2006.01) |
| ***H01R 25/14*** | (2006.01) |
| ***H01R 13/24*** | (2006.01) |
| ***H01R 31/06*** | (2006.01) |
| ***H01R 43/26*** | (2006.01) |
| *F21W 121/00* | (2006.01) |
| *F21Y 105/10* | (2016.01) |
| *F21Y 115/10* | (2016.01) |

(52) U.S. Cl.
CPC ..... *H01R 13/2457* (2013.01); *H01R 25/147* (2013.01); *H01R 31/06* (2013.01); *H01R 43/26* (2013.01); *F21W 2121/008* (2013.01); *F21Y 2105/10* (2016.08); *F21Y 2115/10* (2016.08)

(56) References Cited

U.S. PATENT DOCUMENTS

| | | | | |
|---|---|---|---|---|
| 7,828,557 | B2 * | 11/2010 | Vogt | H01R 4/4818 439/441 |
| 7,892,022 | B2 * | 2/2011 | Mostoller | F21V 19/0055 439/507 |
| 8,834,194 | B2 * | 9/2014 | Sakai | F21V 19/004 439/345 |
| 8,985,813 | B2 * | 3/2015 | Zaderej | F21S 2/005 362/249.02 |
| 9,065,187 | B2 * | 6/2015 | Leshniak | H01R 9/18 |
| 9,146,027 | B2 * | 9/2015 | Zantout | F21V 21/088 |
| 9,301,416 | B2 * | 3/2016 | Zaderej | F21S 2/005 |
| 2006/0054914 | A1 * | 3/2006 | Hsian Yi | H01L 33/486 257/100 |
| 2008/0149960 | A1 * | 6/2008 | Amo | H01L 33/486 257/98 |
| 2010/0141162 | A1 | 6/2010 | Matsumoto et al. | |
| 2010/0293825 | A1 * | 11/2010 | Jensen | H01R 13/2442 40/541 |
| 2015/0198314 | A1 * | 7/2015 | Frederiksen | F21V 19/0025 362/382 |

FOREIGN PATENT DOCUMENTS

| | | | |
|---|---|---|---|
| EP | 2 485 342 | A2 | 8/2012 |
| WO | WO 99/39319 | A2 | 8/1999 |
| WO | WO 03/017435 | A1 | 2/2003 |
| WO | WO 2009/076960 | A1 | 6/2009 |
| WO | WO 2013/117198 | A1 | 8/2013 |
| WO | WO 2015/036330 | A1 | 3/2015 |
| WO | WO 2015/104024 | A1 | 7/2015 |

OTHER PUBLICATIONS

Written Opinion (PCT/ISA/237) dated Jan. 2, 2017, by the European Patent Office as the International Searching Authority for International Application No. PCT/DK2016/050349.
Current Distribution in Parallel LED Strings, OSRAM OPTO Semiconductors, pp. 1-7, Jun. 2011.
LINEARlight Power Flex Protect G2-LF06P2-P, Technical Datasheet, OSRAM, pp. 1-4, Jun. 6, 2014.
LINEARlight Power Flex—LF06P2, Data Sheet, OSRAM, pp. 1-4, Aug. 9, 2012.
Technical application guide LINEARlight Flex Protect LF06A-P/LF06P2-P, OSRAM, pp. 1-18.

* cited by examiner

ELECTRICAL SUPPLY MODULE FOR FLEXIBLE COUPLING

FIELD OF THE INVENTION

The present invention relates to an electrical supply module comprising a composite board with two layers of an electrically conducting material separated by an insulator, an adapter for mounting in the composite board, and a power supply capable of providing power to the electrically conducting layers. The electrical supply module offers greater flexibility since the electrical supply module can be easily coupled to an extension module also based on a composite board. The invention also relates to an electrical supply system and to a lighting fixture.

PRIOR ART

Composite boards are well known construction elements for LED based lamps where two electrically conducting plates separated by an insulating material are used to supply electricity to and from LED's mounted in the composite board. Thus, WO 2003/017435 discloses an adapter for electrical power transfer for mounting in an aperture in such a composite board. The adapter comprises first pins establishing electrical connection with one of the layers when the adapter is mounted in an aperture, and a second pin adapted for establishing electrical connection with the other layer when mounting the adapter in the aperture.

WO 2009/076960 discloses an adapter with a LED for mounting in a hole in a composite board where the LED is fitted on a metal item. The heat conducting properties of the metal item are utilised for conducting heat from the LED away from the adapter and into the board while simultaneously operating as an electric conductor.

Other such systems are disclosed in EP 2485342, DE 102008021014 and WO 2013/117198.

WO 2015/104024 discloses a composite board with a circuit board carrying a LED in electrical connection with the first and the second electrically conducting layers. The composite board may comprise a controller adapted for communication of data signals via one of the electrically conducting layers to the LED.

However, neither of the above documents provides much flexibility since the fixtures cannot be modified with respect to size, especially with respect to the number of LED's.

Flexible LED based lighting systems are known. For example, the company Osram GmbH sells a system known as LINEARlight POWER Flex® Protect G2-LF06P2-P (as described in the Technical Datasheet of 6 Jun. 2014, the Data Sheet of 9 Aug. 2012 and the Technical application guide LINEARlight Flex Protect LF06A-P/LF06P2-P). The LF06P2-P is based on a soft and bendable strip, which can be cut to a shorter length. However, shortening of the strip by cutting is only possible at specifically indicated sites. Cutting the strip at other sites will destroy the lighting system. Moreover, the strip is linear meaning that the flexibility will be limited to a single dimension, and further it is not possible to add additional LED's in an existing strip.

LED lighting systems typically employ serially connected LED's but lighting systems with some flexibility have been disclosed in which LED's or serially connected groups of LED's are connected in parallel. Thus, for example EP 2194761 provides a LED lighting device for lighting a plurality of LEDs connected in series to constitute a plurality of LED arrays connected in parallel. The device includes a switching element connected in series to each of the LED arrays allowing individual arrays to be turned off. The LED's are supplied by a constant current in order to realise a constant light output regardless of used environments.

Osram has published an Application Guide (Current Distribution in Parallel LED Strings, June 2011), which describes problems with connecting LED's in parallel. The LED's in Osram's Application Guide are supplied from a single constant current source; the Application Guide addresses the problem of how to provide an even output from the LED's but does not focus on flexibility.

A further example of LED's coupled in parallel is disclosed in WO 1999/039319.

It is an object of the present invention to provide an electric supply module allowing flexibility with respect to adding or removing electronic components, e.g. LED's. It is furthermore an object to provide a lighting fixture that is more flexible with respect to modification in size and adding or removing LED's than available from the prior art.

DISCLOSURE OF THE INVENTION

The present invention relates to an electrical supply module comprising: a composite board comprising an anode layer and a cathode layer of electrically conducting material, which anode layer and cathode layer are separated by an insulator of electrically insulating material, the anode layer and the cathode layer each having a trench extending from a connection surface of the composite board, an adapter for mounting in a hole extending entirely through or partly through the composite board, the adapter comprising a circuit board carrying an electronic component, the circuit board establishing electrical connection from the anode layer to an anode of the electronic component and electrical connection from the cathode layer to a cathode of the electronic component, a power supply capable of providing a constant voltage or a constant current between the anode layer and the cathode layer.

In a further aspect the invention relates to an electrical supply system comprising an electrical supply module of the invention, an extension module comprising a composite board and an adapter as defined for the electrical supply module, and a connector pin for each trench of the electrical supply module, each connector pin having a first complementary connection element for engaging the connection element of the trench of the composite board of the electrical supply module and a second complementary connection element for engaging the connection element of the trench of the composite board of the extension module. The electrical supply system of the invention requires a single electrical supply module, i.e. of the electrical supply module, and it may contain any number of extension modules. Multiple extension modules can be connected to a single electrical supply module with appropriate connection surfaces, or multiple extension modules can be connected serially to each other. An extension module may also have multiple connection surfaces. The extension module may also be referred to as a supplementary module and the two terms may be employed interchangeably in the context of the invention.

In the context of the invention an "electrical supply module" is a module for supplying electricity to an electronic component carried on a circuit board in an adapter. In the context of the invention an "electrical supply system" is a system comprising an electrical supply module and an extension module where the anode layer of the electrical supply module is in electrical connection with the anode layer of the extension module, and the cathode layer of the electrical supply module is in electrical connection with the cathode layer of the extension module. Likewise, the anode layer and the cathode layer of a first extension module may be in electrical connection with the respective anode layer and cathode layer of a further extension module. By having an anode layer and a cathode layer of an electrically conducting material and a power supply providing a constant voltage or a constant current between the anode layer and the cathode layer a plurality of adapters with electronic components as defined above will be connected in parallel. Parallel connection of a plurality of electronic components with a constant current or a constant voltage in the electrical supply module provides a flexible system where additional electronic components can be added to or removed from the system in a simple fashion. For example, a hole may be provided either partly or entirely through the composite board and an adapter with the additional electronic component may be mounted in the hole, or additional electronic components may be part of an extension module, which may be connected to the electrical supply module. Likewise, due to the constant current or constant voltage a section of a composite board with a plurality of adapters may be removed, e.g. by cutting, without detrimental effects to adapters and their corresponding electronic components remaining in the composite board. Supplying power via the conducting layers removes the need for separate wiring to each electronic component thus providing a simple system. When the electrically conducting material is a metal, in particular aluminium or copper, the resistance of the electrically conducting material is generally so low that the electrical supply module, or the electrical supply system, is not limited with respect to size. In particular, the cross-sectional area of the anode layer and the cathode layer will be much larger than wires typically employed in electric supply systems and thereby the resistance of metallic electrically conducting layers will be correspondingly lower.

A preferred electronic component is a light emitting diode (LED). The electrical supply module of the invention may have any number of adapters, preferably at least two adapters. In a certain embodiment the electrical supply module comprises from 2 to 300 adapters with LED's. When the electrical supply module comprises a plurality of adapters with LED's or series of LED's it is preferred that the power supply provides a constant voltage. In another embodiment the electrical supply module comprises up to 1000 adapters, e.g. 1 to 1000 adapters, with an electronic component. The adapters can be positioned freely on the surface of the composite board, since the layers of conducting material supply power to the electronic components. Especially when the electrically conducting layers are metallic the resistance between adapters will be insignificant regardless of the distance between the adapters. Thus, the positioning of the adapters on the composite board is independent of electrical wiring or specific positions on a circuit board. In particular, this freedom of positioning electronic components, e.g. adapters with LED's, on a two-dimensional surface cannot be achieved in the linear strip systems of the prior art. Thus, the adapters may be positioned freely on the surface defined by the composite board. For example, the adapters may be positioned at regular intervals, e.g. with a distance between the adapters, e.g. with LED's, in the range of from 25 mm to 1000 mm, e.g. about 100 mm or 200 mm. When the adapters are positioned close to each other, e.g. at a distance of 25 mm or less it is possible to obtain a very high luminous intensity. An electrical supply module with a large distance, e.g. 500 mm or more, between the adapters can also take advantage of the flexibility described above—in particular the lack of individual wiring is an advantage for electrical supply modules having a distance between the adapters at 500 mm or more. Likewise, the distance between the adapters may also be smaller, e.g. in the range of 100 mm to 300 mm, such as about 200 mm.

The adapters can also be positioned in different patterns in the composite board, since the positioning is independent on any wiring as the electrically conducting layers supply the electronic components with power. Furthermore, the electrically conducting layers of the composite board allow that an electrical supply module is connected electrically to an extension module as defined above. This allows a further level of freedom in designing an electrical supply module, or electrical supply system, especially when the electronic components comprise LED's, which cannot be achieved with strip based LED fixtures of the prior art. In particular, no additional wiring is needed since the electrical connection between the electrical supply module and the extension module can be obtained using connector pins or coupling devices as defined below.

The power supply may be connected to the electrical supply module as desired. For example, the power supply may be wired to the anode layer and the cathode layer at any location on the composite board. In certain embodiments the power supply provides a constant voltage of a standardised value, e.g. 12 V or 24 V.

The composite board may have any shape as desired as long as it comprises the at least two layers, i.e. the anode layer and the cathode layer, of electrically conducting material separated by the electrically insulating material. The anode layer and cathode layer are separated by an insulator of electrically insulating material. In the context of the invention the term "separate" and its derived forms mean that direct electrical contact between the anode layer and the cathode layer is prevented in order to prevent short circuits between the anode layer and the cathode layer. The composite board may comprise additional elements as desired in order to separate the anode layer and the cathode layer, or the insulator of the electrically insulating material may be the only element separating the anode layer and the cathode layer.

The size of the composite board may be selected freely. In general, the composite board has a thickness reflecting the thickness of the insulator, e.g. in the form of an electrically insulating layer, plus the two electrically conducting layers. The thickness of the composite board is typically in the range of 2 mm to 50 mm. The other two dimensions will typically reflect the intended use of electrical supply module, e.g. as a lighting fixture, and in a certain embodiment the composite board has a size according to recognised standards. For example, the composite board/lighting fixture may be sized to fit under e.g. a kitchen cabinet or the like. Thus, the lighting fixture may have a width of about 600 mm. The length, e.g. the length for a lighting fixture to fit under a kitchen cabinet, may be adjusted by cutting a section off so that the lighting fixture fits an intended number of cabinets. For example, the length may correspond to one or two kitchen cabinets, e.g. 600 mm or 1200 mm. Similar observations are relevant for the electric supply module not in the shape of a lighting fixture. In another embodiment the electrical supply module, and the corresponding extension module, is designed to replace a copper wire for supplying electricity to electronic components, and it has a width in the range of 10 to 100 mm, e.g. 30 mm to 50 mm, such as about 40 mm. In this embodiment the electrical supply system of the invention may also be referred to as a "rail"; a rail may contain modules, i.e. the electrical supply module and extension modules, of a length in the range of 100 cm to 200 cm. In a particular embodiment the electrical supply system may comprise extension modules without any adapters which extension modules can supply electricity to further extension modules having adapters with electronic components. An extension module without any adapters is relevant in any embodiment of the electrical supply system.

The anode layer of the composite board is electrically connected to an anode of the electronic component, and the cathode layer of the composite board is electrically connected to a cathode of the electronic component, but the anode layer and the cathode layer are otherwise not limited. The anode layer may also be referred to as a "first layer" and the cathode layer may also be referred to as a "second layer". Either of the anode layer or the cathode layer may represent a front layer or a back layer of the composite board, and thereby also of the electrical supply module or extension module. In the context of the invention the anode layer and the cathode layer may be referred to collectively as the "electrically conducting layers" or "conducting layers".

The composite board may be extending in two dimensions so that it can be described as "planar". A planar composite board is not limited with respect to thickness, and in general the thickness is defined by the combined thicknesses of the anode layer, the cathode layer and the insulator. The composite board may also be defined in three dimensions and e.g. have a shape representing a section of a sphere, e.g. a hemispherical shape, or an arch. Non-planar composite boards will also have a thickness is defined by the combined thicknesses of the anode layer, the cathode layer and the insulator, and a non-planar composite board is also not limited with respect to its thickness.

The electrically conducting material may be chosen freely, and the conducting layers may be from any conducting material. Likewise, the conducting material may have any thickness as desired. However, it is preferred that the electrically conducting material comprises or is a metal. Preferred metals are metals selected from the list consisting of aluminium, magnesium, copper, titanium, steel, and their alloys. Metals may be anodised to provide the metal with an oxide layer on the surface, and in an embodiment the metal is anodised, e.g. by providing an oxide layer having a thickness of at least 10 μm. When the metal is anodised, the outer surface of the metal is electrically insulating so that an end user is protected from currents running through the electrically conducting materials, i.e. the anode layer and the cathode layer. Anodisation further protects the metal from being corroded. In particular, an electric current running through the anode layer or the cathode layer can make the metal more prone to corrosion but by anodising the metal such corrosion is prevented. Anodisation is especially relevant when the anode layer and/or the cathode layer is constructed from aluminium, magnesium or titanium, or alloys based on these metals. For example, these layers may be anodised to provide oxide layers of at least 10 μm thickness, e.g. about 20 μm $Al_2O_3$. Anodised aluminium, magnesium, or titanium has a protective insulating layer prevented short circuiting and electrical shocks.

In a specific embodiment the electrically conducting layers may be used to provide data communication with the electronic component using direct power line communication (PLC). In further embodiments, the electric supply module comprises additional electrically conducting layers, e.g. between the anode layer and the cathode layer. Additional electrically conducting layers may be used to provide communication to electronic components. When data communication is desired the composite board may be fitted with appropriate data ports, e.g. standardised ports, such as those known as USB, HDMI, Display Port, etc. When data ports are included, appropriate electronic components will typically also be integrated in the composite board. Data ports may be included in the electrical supply module and also in the extension module.

In an embodiment the anode layer and/or the cathode layer is a sheet metal with a thickness up to 5 mm. e.g. in the range of 0.3 mm to 0.7 mm, or in the range of 0.5 mm to 2.0 mm. A preferred metal for the conducting layers is aluminium, e.g. in the form of sheets with a thickness up to 5 mm, e.g. in the range of 0.3 mm to 0.7 mm, or in the range of 0.5 mm to 2.0 mm. Likewise, sheets of magnesium or titanium are also relevant, and the thickness may be up to 5 mm, e.g. in the range of 0.3 mm to 0.7 mm, or in the range of 0.5 mm to 2.0 mm. In a specific embodiment the anode layer and/or the cathode layer is a sheet of copper, optionally coated with an electrically insulating material, e.g. lacquer or paint, on the surface opposite the surface in contact with the insulator.

The trenches each define a length axis, and it is preferred that the length axes of the trenches of the anode layer and the cathode layer are parallel. Parallel length axes of the trenches allow a standardised format for connecting the electrical supply module with an extension module as defined above and also having trenches with parallel length axes. The locations of the trenches in the connection surface and the distance between them will correspond to those of any extension module for connecting to the electrical supply module. However, in an embodiment the electric supply module has a first connection surface with one set of locations and distance between the trenches and second connection surface with another set of locations and distance between the trenches. Thereby a directional system is achieved where extension modules will be connected according to a predetermined direction. In another embodiment all connection surfaces of both the electrical supply module and all extension modules have identical locations of the trenches.

In an embodiment the anode layer and/or the cathode layer has been extruded from a metal, e.g. from aluminium, magnesium, copper, titanium, or steel. In a preferred embodiment the trench is formed in the extrusion process. For example, the trench may be present along a longitudinal axis of the respective layer through the length of the layer. Extrusion of the anode layer and/or the cathode layer is advantageous since it allows manufacture of the respective layer with the trench formed in the extrusion process so that a cheaper process is provided compared to providing a sheet metal or similar and creating the trenches in the layers. Likewise, extrusion allows preparation of an anode layer and/or a cathode layer having a non-uniform thickness. In a preferred embodiment the anode layer and the cathode layer are extruded, e.g. from aluminium or magnesium, to have a cross-section in a plane normal to the longitudinal axis of the respective layer, which cross-section defines a connecting region housing the trench and an adapter region in contact with the insulator of electrically insulating material. The adapter region will generally be thinner than the connecting region, which is sized to contain the trench. Thereby a more robust and flexibly module is provided, since the thickness of the adapter region can be smaller, e.g. having a thickness in the ranges of 0.2 mm to 1 mm, than the thickness of the connecting region, e.g. having a size in the range of 1 mm to 10 mm, e.g. 2 mm to 5 mm, leaving more room for the trench and any connection element. For example, the overall thickness of the composite board may correspond to the combined thickness of the adapter regions of the anode layer and a cathode layer and the thickness of the insulator, e.g. the combined thickness is in the range of 1 mm to 10 mm, e.g. 3 mm to 5 mm, so that the trench may have cross-sectional dimension of e.g. 2 mm to 4 mm. In a specific embodiment the anode layer and the cathode layer are rotationally symmetrical with respect to the connecting regions relative to the normal plane. It is also possible that the anode layer and/or the cathode layer are manufactured by extrusion of a polymer material, e.g. a thermoplastic polymer, which is subsequently coated with a metallic layer to make the layer electrically conducting. In particular, the metallic coating will be between the extruded polymer and the insulator in order to prevent direct contact of an end user with the electrically conducting layers.

The insulator may have any form desired and the electrically insulating material may be any electrically insulating material. It is preferred that the insulating material comprises a flame retardant. In an embodiment the insulator has the form of a sheet between the anode layer and the cathode layer, which may also be in the form of sheets, or which may be extruded to have another form. When the insulator has the form of a sheet its area generally corresponds to at least 50% of the area of the anode layer and/or the cathode layer. The insulator may also define a honeycomb structure or another discontinuous structure. For example, the insulator may take the form of a plurality of pillars or the like between the anode layer and the cathode layer. A plurality of pillars is especially preferred when the electrically conducting layers have been extruded.

The electrically insulating material is preferably a polymeric material. The electrically insulating material may be of low density. For example, the electrically insulating material may comprise an expanded or foamed material (open and/or closed celled), such as expanded polystyrene, and/or a reinforced material such as a fibre glass material. The electrically insulating layer may be made of a polymer material such as amorphous plastic materials (e.g. polyvinylchloride, polycarbonate and polystyrene) or crystalline plastic materials (e.g. Nylon, polyethylene and polypropylene), or wood. In a certain embodiment the electrically insulating material is polyethylene or the like and has a thickness of at least 0.2 mm, e.g. in the range of 1 mm to 6 mm, e.g. 3 mm or 5 mm. A specific composite board is marketed as a Dibond® plate. When the electrically insulating layer is made from wood it will generally be thicker, e.g. in the range of 10 mm to 20 mm. In a certain embodiment the insulator comprises several different materials. It is significant that the insulator separates the anode layer from the cathode layer in order to prevent short circuits, and it is possible that the insulator comprises an electrically conducting material as long as the anode layer is separated from the cathode layer. For example, the insulator may comprise a core of a different material, even a metal, providing strength and rigidity. In a further embodiment the insulator comprises materials of different thermal expansion coefficients so that assembly of the insulator under increased temperature can provide a material of greater rigidity than expected from the individual materials. The same can be observed for assembly of the electrical supply module and/or the extension module when it comprises a thermoplastic polymer as insulator.

In an embodiment the anode layer and the cathode layer, which may be extruded metals, are glued together with an electrically non-conducting glue so that the glue is the insulator. This allows a thinner layer of the insulator, e.g. in the range of 0.2 mm to 0.5 mm, since the insulator can be applied in a liquid form, e.g. at ambient temperature, so that the total thickness of the electrical supply module is thinner than can be achieved using a solid material as insulator. It is preferred when the insulator is a glue that the hole for the adapter is made in the anode layer or the cathode layer as desired before gluing the electrically conducting layers together.

The composite board has a connection surface. The connection surface allows that the electrical supply module is brought into electrical contact with an extension module as defined above. In particular, the anode layer of the composite board of the electrical supply module is brought into electrical connection with the anode layer of the extension module and the cathode layer of the composite board of the electrical supply module is brought into electrical connection with the cathode layer of the extension module. In general, the extension module may comprise any feature of any embodiment of the electrical supply module, but the extension module does not have a power supply. In a specific embodiment the composite board has two connection surfaces with one connection surface at each end of the composite board. However, more complex designs of the composite boards are also contemplated where the composite board has multiple connection surfaces, e.g. one or two connection surfaces at the ends of the composite board with additional connection surfaces at a side of the composite board.

The connection surface may have any angle with respect to the composite board, which allows electric connection with the extension module. Thus, the connection surfaces of the composite boards of the respective electrical supply module and extension module typically have angles allowing contact between the connection surfaces. For example, the electrical connections may be provided by bringing the electrically conducting material of the respective layers into direct contact. In a certain embodiment the connection surface defines a plane, which is normal to a longitudinal axis of the respective composite boards. In another embodiment the connection surface defines an angle for connecting to an extension module having a connection surface of a matching angle in order to provide a desired angle between the electrical supply module and the extension module. For example, the electrical supply module may have a connection surface at an angle of 45°, e.g. 45° to the longitudinal axis in any plane, for connecting to an extension module also having a connection surface at an angle of 45° in order to connect the electrical supply module and the extension module at an angle of 90°.

The anode layer and the cathode layer each have a trench extending from the connection surface. The trenches allow connection, e.g. a securing connection, between the composite boards of the electrical supply module and an extension module. The trench may have any shape as desired. For example, the trench may have a rectangular cross-section or the cross-section may have the form of a full circle or any section of a circle, e.g. a semicircle. The trench or trenches may have an open side facing a surface of the anode layer or the cathode layer as appropriate or a trench may extend from the connection surface, e.g. be drilled into the anode layer or the cathode layer, so that the trench is enclosed in the electrically conductive material of the anode layer or the cathode layer, as appropriate.

It is preferred that each trench comprises a connection element for engaging with a complementary connection element of a connector pin. In the context of the invention the term "engage" and its derived forms mean that a connection element is fastened to its complementary connection element; the fastening may be permanent, e.g. so that separation of the connection element and its complementary connection element will result in destruction of the connection element and/or the complementary connection element, or the engagement may be a releasable fastening, e.g. so that separation of the connection element and its complementary connection element will not affect future use of the connection element and its complementary connection element. Likewise, in the context of the invention a "connector pin" can connect an electric supply module of the invention with an extension module, e.g. in the electric supply system of the invention, to provide a permanent or releasable fastening of the electric supply module to the extension module.

The connector pin has complementary connection elements for engaging the corresponding connection elements of the trenches of the respective modules, and it may be designed freely. However, it is preferred that the connector pin is rigid in order to securely connect the electrical supply module and the extension module. The connector pin will generally have a length in the range of 5 mm to 50 mm, e.g. 10 mm to 25 mm, and the trenches will have lengths to fully accommodate the connection pin. The cross-section of the connector pin may be round or square and have a cross-sectional dimension in the range of 1 mm to 10 mm, e.g. 2 mm to 5 mm. The connector pin may have a linear shape or it can comprise an angle between to linear sections. Regardless of the shape of the connector pin, the connector pin may comprise a flexible link between the first complementary connection element and the second complementary connection element, e.g. so that the section having the first complementary connection element is flexibly linked to the section having the second complementary connection element. A flexible link between the first and the second complementary connection element generally allows fitting the electrical supply module with the extension module at an improved tolerance than can be obtained using a rigid, e.g. a rigid linear or a rigid angled, link. The flexible link may be elastic or it may be soft with low elasticity. When the flexible link has low elasticity or is soft it is preferred that the electrical supply system comprises a coupling device.

In general, two connector pins are employed for each connection surface between an electrical supply module and an extension module, and the two connector pins for the same connection surface are typically identical. However, a connection surface may comprise further trenches and a corresponding number of connection pins. When the connector pins have an angle it is possible to connect the electrical supply module and the extension module at the angle of the connector pin. The trenches may follow the longitudinal direction of the electrically conducting layers, so that the angle of the connector pins will correspond to the angle between the electrical supply module and the extension module. In an embodiment the complementary connection element of the connector pin comprises one or more lengthwise springs that bulge outwards from the connector pin and press against the walls of the trench, optionally fitted with ridges, or against the inner surface of a hollow metallic cylinder serving as a connection element, thereby improving the electrical contact and preventing the connector pin from falling out and securing the connection between the electrical supply module and the extension module. A connector pin with one or more lengthwise springs may also be referred to as a "banana connector", and any design of banana connector as known to the skilled person may be employed in the present invention. In an alternative embodiment the trench is fitted with one or more lengthwise springs that bulge outwards from the wall of the trench to provide the connection element. In this embodiment it is preferred that the connector pin comprises ridges, e.g. ridges transverse to a length axis of the connector pin, for securing connection between the trench and the connector pin. When a connection element comprises lengthwise springs, ridges on the complementary connection element may matches with the lengthwise positioning of the bulge or bulges of the spring and likewise when lengthwise springs are employed in the trench.

It is preferred that the connector pin comprises, or consists of, an electrically conducting material and that the electrical connection between the layers of the electrical supply module and an extension module is provided via the connector pin. It is especially preferred that the connector pin is made of metal, e.g. brass, and has one or more lengthwise springs, e.g. also of brass, that bulge outwards from the connector pin.

In an embodiment the connection element is provided as opposite walls of the trench with a polygonal, e.g. rectangular, or circular cross-section, and the complementary connection elements of the connector pin may be a spring or elastic section providing a press-fit between the connector pin and the trench, e.g. the walls of the trench. The trenches of the composite board of an extension module may also have connection elements for engaging with a connector pin with complementary connection elements. Thus, the electrical supply module or the electrical supply system may comprise a connector pin for each trench of the electrical supply module, each connector pin having a first complementary connection element for engaging the connection element of the trench of the composite board of the electrical supply module and a second complementary connection element for engaging the connection element of the trench of the composite board of the extension module. Thereby the extension module is securely connected to the electrical supply module.

In an embodiment the trench or each trench comprises a ridge extending along a wall of the trench. The ridge may follow the length axis of the trench, or the ridge may have another orientation. For example, when the anode layer or the cathode layer have been manufactured by extrusion the ridge may be formed during the extrusion process. The ridge may have any shape and size as deemed appropriate. For example, the ridge may have a triangular cross-section, relative to the length axis of the trench. The ridge will typically have a "height" or protrusion from the wall of the trench in the range of 0.1 mm to 1 mm. The ridges may constitute connection elements for engaging with a complementary connection element of a connector pin. For example, the ridges may be angled, e.g. at a right angle, to the length axis of the trench to thereby form barbs for engaging with the complementary connection element of a connector pin, which may comprise a spring or an elastic section. In a certain embodiment the trench has a polygonal cross-section relative to the length axis of the trench, and the trench has a ridge on each wall of the trench as defined by the polygonal shape, the ridge or ridges following the length axis of the trench. For example, the trench may be open to either surface of the respective layer and have a rectangular, e.g. square, cross-section, with a ridge following the length axis of the trench on each wall of the trench so that the trench has opposed ridges. Likewise, the trench may be open to either surface of the respective layer and have a cross-section corresponding to a section of a circle with two or three ridges following the length axis of the trench on the wall of the trench.

In an embodiment the connection element is a hollow metallic cylinder with an outer helical thread. The outer helical thread may be screwed into the trench so that tight electrical contact is established between the hollow metallic cylinder and the electrically conducting material of the anode layer or the cathode layer having the trench. A hollow metallic cylinder is especially appropriate when the electrically conducting material is a metal. The outer diameter of a hollow metallic cylinder will correspond to, e.g. be equal to or slightly larger or smaller than, a cross-sectional dimension of the trench. The hollow metallic cylinder has an inner diameter corresponding to the size of, e.g. being equal to or slightly larger than, the cross-sectional dimension of a connector pin. In a particularly preferred embodiment the electrically conducting material is anodised aluminium, magnesium or titanium, and the trenches have ridges, e.g. as obtainable by extrusion of the anode layer or the cathode layer, and the connection element is a hollow metallic cylinder with an outer helical thread. It is especially preferred that the trench, e.g. being open to either surface of the respective layer, has at least three ridges along the length axis of the trench with the tips of the ridges being placed on the perimeter, e.g. distributed evenly on the perimeter, of a circle defined in a plane normal to the length axis of the trench. When the hollow metallic cylinder, e.g. having a diameter slightly larger than the diameter defined by the trenches, with the outer helical thread is screwed into the anodised metal, e.g. having an oxide layer of at least 10 μm, the oxide layer is more easily penetrated by the metal of the hollow metallic cylinder since the outer helical thread only has to penetrate the oxide layer at the much smaller surface of the ridge(s), e.g. three ridges, as compared to penetrating the larger surface of the wall of the trench. Thus, when the anode layer or the cathode layer is anodised aluminium, magnesium or titanium, and the trenches have ridges following the length axis of the trenches a hollow metallic cylinder with an outer helical thread as the connection element together provide a better electric contact to the connector pin. A preferred metal for the hollow metallic cylinder is brass or steel coated with nickel, brass, steel or copper, optionally coated with gold or silver. Especially the inner surface of the hollow cylinder may be coated with gold or silver.

The electric supply system may comprise any number of extension modules as defined above. In addition to the connector pins the electric supply system may also comprise one or more coupling devices. The coupling devices can provide further stability to the electric supply system. The coupling device of the electric supply system may take any form allowing appropriate connection between sections of the system, e.g. between electrical supply module and an extension module. In general, the coupling devices connect the electric supply system and the extension module, and the connection may also include electrical connections so that the first electrically conducting layer of a first section is connected with the first electrically conducting layer of a second section and the second electrically conducting layer of the first section is connected with the second electrically conducting layer of the second section.

The coupling devices may be made from any material and may comprise an electrically conducting material for establishing electrical connections between the appropriate layers. For example, the coupling devices may be made of a polymeric material and have a metallic coating or layer for establishing electrical connection, or the coupling devices may be metallic. In an embodiment of the invention the coupling device is made of a polymeric material having a metallic resilient layer between the polymer material and the lighting fixture of the invention. The metallic resilient layer provides both electrical connection between an electrical supply module and an adjacent extension module and also a structural function where the resilience holds the three components, i.e. the electrical supply module, the extension module and the coupling device, in place. The coupling devices may also be designed so as to create a direct electrical connection between the electrically conducting layers of two sections. In general, the coupling devices are designed to connect two sections at a specified angle, which may be chosen freely. In certain embodiments the lighting fixture system or the lighting fixture kit are based on planar composite boards, and the coupling devices can be a corner bracket, e.g. for connecting two sections at a specified angle, such as 90°, a straight bracket for connecting two sections in a straight line, or a T-bracket for connecting a first composite board to a mid section of a second composite board. The coupling devices can also connect sections in other dimensions than a plane, e.g. a plane of a first section. For example, different sections, e.g. planar sections, may be connected in different planes or dimension.

It is also contemplated that the electrical supply module is provided with a power supply that is not limited to providing a constant current or a constant voltage. For example, a complete system may be designed with a specified set of electronic components in the composite board or in several composite boards when an extension module is included in the design. However, this embodiment does not have the flexibility of the preferred embodiments of allowing additional electronic components to be added freely to the system or removing electronic components.

It is preferred that the electrical supply module, and also any extension module employed, comprises a plurality of adapters as defined above. The electronic component may be chosen freely, and for example the electronic component is selected from the list consisting of a light emitting diode (LED), a series of LED's, a resistor, a transistor, a controller, a chip on board (COB), a driver, a microphone, a camera, a sensor, a radio transmitter, a radio receiver, an antenna, an access point for wireless communication, e.g. WiFi, LiFi, Bluetooth, etc. Regardless of the nature of the electronic component, the adapters housing the electronic components are in parallel electric connection in the electrical supply module and in any extension module connection to the electrical supply module.

The adapter may be any adapter capable of being mounted in a hole in the composite board as defined above and thereby establishing electrical connection between the conducting layers and the anode and the cathode as described above. The adapter may comprise a retaining element corresponding to a section of the perimeter of the hole or the whole perimeter of the hole. A retaining element is especially suited when the hole is provided in a pre-assembled composite board, e.g. in the form of a dibond plate. However, the hole may also be established in each of the layers, e.g. in the anode layer and the insulator before assembly of the layers. When the hole has been established prior to assembly of the layers, the retaining element is generally not needed. In particular, the holes in the anode layer (or the cathode layer, as desired) and the hole in the insulator may be sized so that the hole in the insulator is larger than the hole in the anode or cathode layer thereby providing a retaining function. For example, the retaining element may be designed so that the adapter can be press fitted into the hole, or the hole and the retaining element may comprise complementary engagement means. Complementary engagement means may be an external thread on the retaining element and a corresponding internal thread in the hole. In an embodiment, a hole, e.g. round, square, or rectangular, is provided in the anode layer or the cathode layer as desired, and the electrically conducting layers are aligned with an insulator having a larger hole than provided in the respective conducting layer. This allows positioning of a circuit board having a larger dimension than the hole in the conducting layer before assembly of the electrical supply module so that the circuit board is retained by being larger than the hole. For example, the circuit board may be glued to the back layer. The bottom layer, either the cathode layer or the anode layer as appropriate, may also comprise a hole of a size and shape corresponding to the hole in the insulator, but which hole does not fully penetrate the bottom layer. This allows for an adapter which is thicker than the insulator.

The adapter may also be soldered or glued to the composite board. The retaining element may be made of a polymer or a metal or a combination of a polymer and a metal. The adapter may comprise any other component or element as appropriate. In a certain embodiment the adapter may be removably fitted in the hole. In another embodiment the adapter is permanently fitted in the hole meaning that its removal will destroy the adapter.

The hole preferably has a round perimeter but it may also have a square or rectangular perimeter, or a perimeter of another shape. The hole may have any appropriate size, but in a certain embodiment the hole has a first dimension in the range of 5 mm to 50 mm, and a second dimension in the range of 5 mm to 50 mm. For example, the hole may be round and have a diameter in the range of 5 mm to 50 mm. The hole may also be larger, e.g. having a diameter up to or at 100 mm.

In it simplest form the adapter comprises the circuit board, e.g. a printed circuit board (PCB), and any element necessary to establish the electrical connections. For example, the hole in the composite board may go through the front layer, whether this is the anode layer or the cathode layer, and the insulator but not the back layer so that the back layer forms a support for the circuit board, which is glued to the back layer. It is preferred that the glue, e.g. in a layer of a thickness in the range of 50 μm to 100 μm, is both electrically and thermally conducting so that the gluing establishes the electrical connection from the electronic component to the back layer and further leads excess heat away from the electronic component. This is especially advantageous when the electronic component is a LED and the back layer is aluminium. Electrical connection from the front layer to the circuit board may be established using an electrically conducting element, e.g. a resilient element in press between the front layer and the circuit board. The circuit board may be any component capable of carrying the electronic component and establishing electrical connection from the first layer to an anode of the electronic component and electrical connection from the second layer to a cathode of the electronic component. The circuit board is not limited to a "board" shape and is defined solely functions outlined above. In its simplest form the "circuit" of the circuit board provides electrical contacts between the anode and the cathode of the electronic component and the two conducting layers, respectively. The circuit board may be any kind of material, e.g. plastic, metal etc., provided with the circuit for transmission of electricity. The circuit may be attached to the circuit board in any way, e.g. by printing, soldering, gluing or the like. In a certain embodiment the circuit board is a PCB.

It is particularly preferred that the electronic component is a LED or a series of LED's. When the electric supply module comprises a plurality of LED's or a plurality of series of LED's the electric supply module may also be referred to as a lighting fixture. In another aspect the invention relates to a lighting fixture comprising:

a composite board comprising at least two layers of electrically conducting material comprising a first layer and a second layer that are separated by at least one insulator of electrically insulating material, a plurality of adapters for mounting in holes extending entirely through or partly through the composite board, each adapter comprising a circuit board establishing electrical connection from the first layer to an anode of an electronic component and electrical connection from the second layer to a cathode of the electronic component, the electronic component being a LED or a series of LED's carried on the circuit board, and a single power supply capable of providing a constant voltage between the first layer and the second layer.

By connecting the LED's in parallel in the composite board and supplying power at a constant voltage via the conducting layers a lighting fixture is provided with flexibility to allow removal or addition of LED's and also physically adjustment of the size of the lighting fixture as desired. For example, a lighting fixture containing e.g. 20 LED's may be adjusted in size, e.g. by cutting, as desired, for example to fit under a kitchen cabinet or the like. When one or more LED's are removed from the lighting fixture, e.g. by cutting off a section of the lighting fixture containing one or more LED's, the conducting layers will ensure that power is supplied to the remaining LED's and the constant voltage will ensure that each LED receives the necessary current to drive the LED. Supplying power via the conducting layers removes the need for separate wiring to each LED providing a simple system. It is also advantageously possible to add additional LED's to a lighting fixture. For example, a hole can be established in a lighting fixture and an adapter as defined above can be inserted in the hole. Power will be supplied to the inserted LED via the conducting layers and the constant voltage will ensure that the original LED's in the composite board and the inserted LED receive an appropriate current to drive the LED's.

Correspondingly it is also possible to couple a lighting fixture of the invention with further composite boards, or extension modules, carrying LED's, and in another aspect the invention relates to lighting fixture system comprising:

a lighting fixture of the invention and a supplementary module comprising:

a composite board comprising at least two layers of electrically conducting material comprising a first layer and a second layer that are separated by at least one insulator of electrically insulating material, one or more adapters for mounting in holes extending entirely through or partly through the composite board, each adapter comprising a circuit board establishing electrical connection from the first layer to an anode of an electronic component and electrical connection from the second layer to a cathode of the electronic component, the electronic component being a LED or a series of LED's carried on the circuit board, and a coupling device for providing connection, e.g. electrical connection, between the first layer of the lighting fixture and the first layer of the supplementary module, and electrical connection between the second layer of the lighting fixture and the second layer of the supplementary module. The advantages observed above for the lighting fixture are also relevant when the lighting fixture and the supplementary module are connected electrically via the coupling devices. The coupling devices may take any form allowing electrical connection between the conducting layers of the lighting fixture and the supplementary module.

In yet a further aspect the invention relates to a lighting fixture kit comprising:

a composite board comprising at least two layers of electrically conducting material comprising a first layer and a second layer that are separated by at least one insulator of electrically insulating material, one or more adapters each comprising a circuit board carrying an electronic component, being a LED or a series of LED's, each adapter being designed to fit in a hole extending entirely through or partly through the composite board and by fitting in the hole establishing electrical connection from the first layer to an anode of the electronic component and electrical connection from the second layer to a cathode of the electronic component, and a power supply capable of providing a constant voltage between the first layer and the second layer.

The lighting fixture kit may also comprise instructions for establishing a hole in the composite board and fitting the adapter in the hole. Likewise, the instructions may also describe how to establish trenches, as defined above, in the electrically conducting layers. Connector pins may also be included in the kit. The lighting fixture kit may also comprise a coupling device and a supplementary module as defined above.

The advantages observed above for the lighting fixture are also relevant when the adapter with the LED or series of LED's of the lighting fixture kit is fit in the composite board and the composite board is connected electrically to the power supply. The lighting fixture kit allows an end user complete freedom as to where to position the adapters with the LED or LED's in the composite board.

In yet a further aspect the invention relates to a method of producing an electrical supply module, e.g. a lighting fixture, the method comprising providing an electrical supply module of the invention having a plurality of adapters and removing a section of the composite board, the section containing one or more of the adapters, which removal leaves the circuit board of at least one adapter in electrical connection with the power supply. The electrical supply module produced according to the method will have fewer adapters with electronic components, e.g. LED's or series of LED's, than the initial lighting fixture but since a constant voltage or constant current is supplied via the conducting layers each remaining electronic component is supplied with an appropriate current or voltage, and all advantages of the electrical supply module are obtained for the produced electrical supply module. The method is especially relevant when the electrical supply module is a lighting fixture, in particular the lighting fixture aspect of the invention. In yet a further aspect the invention relates to a method of producing an electrical supply module, e.g. a lighting fixture, the method comprising providing an electrical supply module of the invention, providing one or more adapters, each adapter comprising a circuit board carrying an electronic component, e.g. a LED or a series of LED's, the adapter being designed to fit in a hole extending entirely through or partly through the composite board and by fitting in the hole establishing electrical connection from the first layer to an anode of the electronic component and electrical connection from the second layer to a cathode of the electronic component, establishing a hole extending entirely through or partly through the composite board, fitting the adapter in the hole.

In yet a further embodiment the invention relates to a method of producing a lighting fixture, the method comprising providing a composite board comprising at least two layers of electrically conducting material comprising a first layer and a second layer that are separated by at least one insulator of electrically insulating material, providing one or more adapters, each adapter comprising a circuit board carrying an electronic component, being a LED or a series of LED's, the adapter being designed to fit in a hole extending entirely through or partly through the composite board and by fitting in the hole establishing electrical connection from the first layer to an anode of the electronic component and electrical connection from the second layer to a cathode of the electronic component, providing a power supply capable of providing a constant voltage between the first layer and the second layer, establishing a hole extending entirely through or partly through the composite board, fitting the adapter in the hole, and electrically connecting an anode of the power supply to the first conducting layer and a cathode of the power supply to the second conducting layer. In the methods of the invention it is preferred that the holes fit the adapter.

The circuit board carries an electronic component, which may comprise or be a LED or a series of LED's. The LED preferably has the form of a surface mounted device (SMD). In a series of LED's the LED's are electrically serially connected on the circuit board. The LED may be any LED as desired. For example, the LED may provide light of a specific colour, or the LED may provide white light, e.g. of a colour temperature in the range of 1,500 K to 8,000 K. An adapter with white LED's will typically provide a luminous intensity in the range of from 50 lumen to 500 lumen, although the lighting fixture of the invention is not limited to adapters providing luminous intensities in this range. The "electronic component" is not limited to one component and further it is not limited to LED's. For example, the electronic component may also comprise a resistor, a transistor, a controller, a chip on board (COB), a driver, a microphone, a camera, a sensor, e.g. a sensor for temperature or humidity, etc. Other components are preferably also in a surface mounted form. When the electronic component comprises other entities than a LED these may be connected as desired, e.g. in series or in parallel with the LED or LED's. A LED will have a forward voltage ($V_f$) that is needed to power the LED and turn it on. In the context of the invention the electronic component is considered to have a combined forward voltage ($V_f$) for all components on one circuit board. Each adapter in a lighting fixture of the invention will generally have electronic components of the same nominal forward voltage ($V_f$). The forward voltage ($V_f$) may also be referred to as the threshold voltage.

LED's will have a nominal forward voltage ($V_f$) but the actual forward voltage ($V_f$) may vary between LED's with the same nominal forward voltage ($V_f$). If a number of LED's are connected in parallel and the actual forward voltages ($V_f$) vary between the LED's each LED will not be supplied with an optimal current resulting in different amounts of lumen produced from each LED despite it that the LED's are nominally identical. This problem can be minimised by connecting a series of LED's in each electronic component thereby statistically evening out the variation. It is therefore preferred that the electronic component comprises a series of 2 to 10 LED's. Similar observations are relevant also for other electronic components. The problem of variation in actual forward voltages ($V_f$) is especially pronounced for high power diodes, e.g. with power ratings above 1 W. When the LED's have a power rating in the range of 0.1 W to 1.0 W the problem of mismatches in actual forward voltage ($V_f$) will be minimal. In a preferred embodiment each electronic component comprises a series of 2 to 10 serially connected LED's with a power rating in the range of 0.1 W to 1.0 W. In a particularly preferred embodiment each electronic component comprises 2 to 6, e.g. 4, serially connected LED's with a power rating in the range of 0.2 W to 0.4 W. In this range of power rating the serially connected LED's will circumvent the problem of mismatching of actual forward voltages ($V_f$), and the same luminous intensity from each series of LED's is achieved. However, the LED's may also have a power rating higher than 1 W, e.g. in the range of 3 W to 10 W, or even higher than 10 W.

Another solution to the mismatching of actual forward voltages ($V_f$) can be provided by including a resistor, in particular an adjustable resistor, in series with the LED or series of LED's on the circuit board.

The lighting fixture of the invention comprises a single power supply capable of providing a constant voltage, i.e. a direct current, between the first layer and the second layer. The constant voltage is generally higher than the forward voltage ($V_f$) of the electronic components of the adapters. Thereby it is ensured that the power supply can power the electronic components. The constant voltage may be chosen freely depending on the forward voltage ($V_f$) of the electronic components. It is preferred to employ standardised constant voltages, e.g. 12 V or 24 V. It is further preferred that the electronic components of circuit boards have a forward voltage ($V_f$) in the range of 60% to 100% of the constant voltage of the power supply. For example, the electronic component may be a series of 4 LED's with a nominal $V_f$ of about 3 V so that the combined $V_f$ of the electronic component will be about 12 V.

The lighting fixture of the invention may also be set up to have a first adapter having a circuit board further comprising a transistor and optionally a resistor, which first adapter represents a reference point, and wherein each circuit board of the remaining adapters comprises a transistor, the adapters defining a current mirror based on the reference point. A current mirror is well known to the skilled person.

The lighting fixture of the invention may have any number of adapters as long as there is a minimum of two adapters.

When metallic electrically conducting layers are used in the composite boards the LED's may be in thermally conducting connection with the electrically conducting layers, and since metals are generally efficient thermal conductors the electrically conducting layers will provide a heat sink for the LED's. Heat sinks are especially relevant when the LED's or series of LED's have power ratings or combined power ratings, respectively, of 1 W or more. Thereby, it is possible to position the adapters in close vicinity, e.g. within 20 mm, without risk of heat damaging the LED's. In a specific embodiment the LED, in particular as a SMD, is mounted on a thermal conductor component, which in turn is mounted on the circuit board. The thermal conductor component may also be referred to as a heat sink. The thermal conductor component serves to conduct heat away from the LED and eventually to the electrically conducting layers of the composite board. When the LED is mounted on a thermal conductor component it is further preferred that the circuit board is also metallic and thereby helps in conducting heat away from the LED's. The thermal conductor component may be any appropriate material, e.g. a metal, silicon carbide or another thermally conducting material or a combination of these materials. The thermal conductor component will typically have a superficial area equal to or larger than the superficial area of the LED, e.g. the SMD LED, and the thickness of the thermal conductor component may be in the range of 0.1 mm to 2 mm, e.g. 0.5 mm to 2 mm. By using a thermal conductor component, a lighting fixture is provided where heat generated by LED's is efficiently removed from the LED's. This improves the lifetime of the LED's and also provides greater freedom of positioning the LED's in the composite plate since the adapters can be positioned without concern of excessive heating in an area with closely positioned LED's, especially when the LED's have a combined power rating of 1 W or more.

The lighting fixture may further comprise a light processing layer on top of the electrically conducting layer with the LED's. The light processing layer may be a polymer panel or film, such as an opalised acrylic panel/film, a clear acrylic panel/film, an acrylic prismatic panel/film, a transparent or semitransparent coloured panel/film, a lens and/or an acrylic lens panel. The panel or film protects the electronic component e.g. from water and/or scatter and/or diffuse and/or focus light emitted from the electronic component. This is advantageous when the lighting fixture is for outdoor use or is a ceiling panel where a particular kind of light is desired for different applications such as lighting for office work, hall way lighting, operating room lighting etc. In a specific embodiment the adapter comprises a sealing making the lighting fixture water tight, especially when the lighting fixture also comprises a light processing layer. A sealing may also be employed in the electrical supply module of the invention, and it may be used in the extension module.

It should be understood that combinations of the features in the various embodiments and aspects are also contemplated, and that the various features, details and embodiments may be freely combined into other embodiments. In particular, it is contemplated that all definitions, features, details, and embodiments regarding the lighting fixture, the lighting fixture system, the lighting fixture kit, the electrical supply module, the extension module and the methods of producing a lighting fixture apply equally to one another. In particular, any feature mentioned in the context of the lighting fixture is equally relevant for the electric supply module and the extension module, especially when the respective modules comprise a plurality of LED's or a plurality of series of LED's.

Reference to the figures serves to explain the invention and should not be construed as limiting the features to the specific embodiments as depicted.

BRIEF DESCRIPTION OF THE FIGURES

In the following the invention will be explained in greater detail with the aid of an example and with reference to the schematic drawings, in which.

DETAILED DESCRIPTION OF THE INVENTION

The present invention relates to an electrical supply module 1 and electrical supply system 100, and to a lighting fixture, a lighting fixture system, a lighting fixture kit, and methods of producing an electrical supply module or a lighting fixture.

In a specific embodiment the electrical supply module is a lighting fixture, which employs light emitting diodes (LED) and can be used for general illumination. The lighting fixture provides flexibility for fitting into a spatially limited location by adjusting the size of the lighting fixture as desired. In the context of the invention the term "LED" may refer to a single LED or several, e.g. 2 to 10, serially connected LED's, unless otherwise noted. The LED is an example of an "electronic component" and the terms may be used interchangeably. However, an electronic component may also be another component than a LED. A LED will have a forward voltage ($V_f$) required to power the LED and make it light. The LED's are preferably white light LED's providing white light with a colour temperature in the range of 1,500 K to 8,000 K, e.g. in the range of 2,500 K to 3,000 K, or 2,700 K to 3,200 K, or 3,000 K to 3,500 K, or 3,500 K to 4,500 K, or 4,500 K to 6,000 K, or 6,000 K to 8,000 K. LED's are typically supplied with a nominal forward voltage ($V_f$) e.g. 3 V, but the actual $V_f$ of a LED may differ from the nominal $V_f$. For example, for a LED with a nominal $V_f$ of 3 V, the actual $V_f$ may vary with ±0.1 V when the LED has a power rating in the range of 1 W to 5 W or more (a "high power LED"), whereas a LED with a nominal $V_f$ of 3 V may vary with ±0.05 V when the LED has a power rating of less than 1 W (a "medium power LED"), e.g. a power rating in the range of 0.2 W to 0.4 W. It is therefore particularly advantageous that each adapter in the lighting fixture of the invention comprises a series of medium power LED's, e.g. 2 to 6 LED's with a power rating in the range of 0.2 W to 0.4 W, since the lower variation in actual $V_f$ compared to the nominal $V_f$ can reduce the problem of mismatching of actual $V_f$ values when the LED's are in parallel electrical connection.

Figure 1:
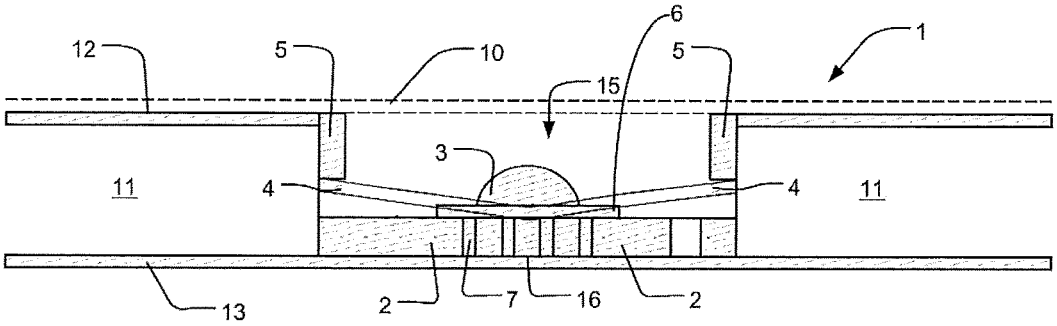
FIG. 1 shows a cross-sectional view of an adapter used in an electric supply module of the invention.
Figure 2:
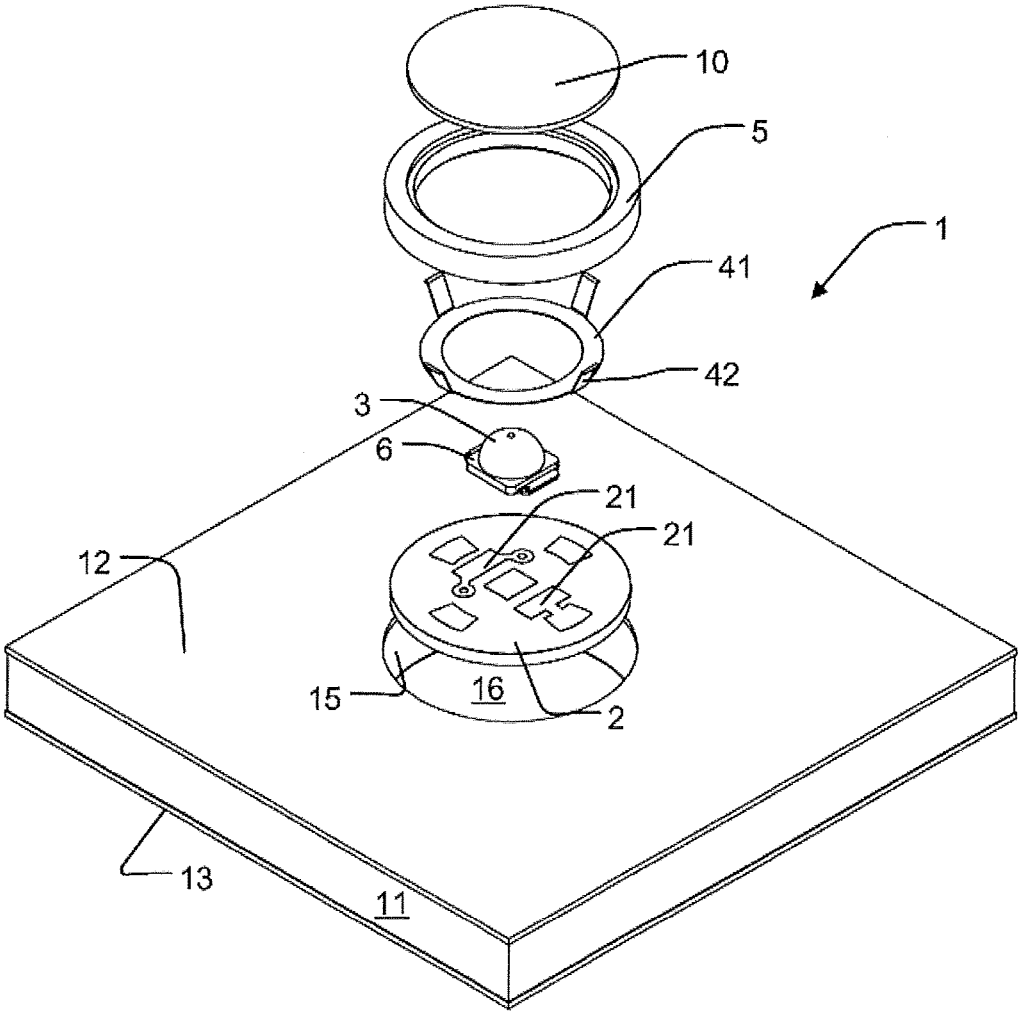
FIG. 2 shows an exploded view of an adapter used in an electric supply module the invention.

Referring now to the figures, an embodiment of an adapter of the electric supply module 1, e.g. a lighting fixture, according to the present invention is depicted in a cross-sectional view in FIG. 1, and an embodiment of an adapter of a lighting fixture according to the present invention is depicted in an exploded view in FIG. 2. The LED may readily be replaced by other electronic components in the adapter.

FIG. 1 shows a part of an electric supply module 1, e.g. a lighting fixture. The composite board in this embodiment comprises an insulator 11 in the form of an electrically insulating layer, e.g. polyethylene, positioned between two electrically conducting layers 12,13. The electrically conducting anode layer 12 is shown as an "electrically conducting front layer", and cathode layer 13 is shown as an "electrically conducting back layer". It is also possible that the front layer is the cathode layer and that the back layer is the anode layer. The electrically conducting layers 12,13 are made of e.g. aluminium, but may be made electrically conducting by the use of other conducting materials. When aluminium is used it is preferably anodised, e.g. to have an oxide layer of about 20 μm thickness. The composite board is provided with a hole 15, in this case a cylindrical hole, through the electrically conducting layer 12 and the insulator 11. The hole 15 comprises a bottom 16 constituted by the electrically conducting back layer 13 and wall(s) constituted by the insulator 11 and the electrically conducting layer 12. The hole 15 may also have perimeters of other shapes, e.g. superficial shapes, such as square, rectangular, triangular perimeters etc. Inside the hole a circuit board 2, e.g. a printed circuit board (PCB), is provided. The circuit board 2 is the same shape and size, or slightly smaller size, than the bottom of the hole 15. It may also be even smaller, larger or a different shape. A LED 3 as a surface mounted device (SMD) is attached to the circuit board 2. Alternatively, another kind of LED can be used. The SMD LED 3 comprises a first and a second electrical terminal (not shown), functioning as the cathode and anode, respectively.

In the embodiment shown, the first electrical terminal is in a first electrical connection with the electrically conducting front layer 12, and the second electrical terminal is in second electrical connection with the electrically conducting back layer 13.

The first electrical connection between the electrically conducting front layer 12 and the first electrical terminal is formed via a conductor, preferably a printed conductor, on the circuit board 2 and further conductors as appropriate. In the embodiment shown, the first electrical terminal is in electrical connection with an electrically conducting element 4, e.g. a resilient electrically conducting element in the form of a wave spring, a washer ring, a spring washer, a disc spring or a coil etc., positioned along the circumference of the hole 15, which is further in electrical connection with an electrically conducting retaining element 5, extending along the circumference of the hole and between the electrically conducting front layer 12 and the electrically conducting element 4. The conducting retaining element 5 is especially appropriate when the hole 15 is made into a preformed composite board, e.g. a dibond plate. When the hole is established in one or both layers, in particular the "front layer", of a composite board before assembly of the composite board a conducting retainer element is typically not used. In a specific embodiment the electrically conducting element 41 is a metallic ring with one or more legs, e.g. 4 legs, providing resilience. The electrically conducting retaining element 5 may be a metal ring, e.g. a copper or aluminium ring, at the circumference of the circuit board 2. The electrically conducting element 4 is preferably made of a suitable metal e.g. spring metal, copper, an aluminium alloy etc. The electrically conducting element 4 is in press between the circuit board 2 and an electrically conducting retaining element 5 in the form of an, e.g. metallic, electrically conducting retainer ring, extending along the circumference of the hole and between the electrically conducting front layer 12 and the electrically conducting element 4. The electrically conducting element 4, e.g. in the form of a wave spring, is waved along the edge such that the edge of the wave spring alternately is in contact with the electrically conducting retaining element 5 and the circuit board 2. The electrically conducting retaining element 5 thus establishes an electrical contact to the electrically conducting front layer 12. The electrically conducting element 4 and the electrically conducting retainer ring 5 further keep the circuit board 2 in place. The circuit board 2, the electrically conducting element 4, and the electrically conducting retaining element 5 can be considered to constitute the adapter. In a specific embodiment the circuit board 2, the electrically conducting element 4, and the electrically conducting retaining element 5 are joined together for easy insertion of the adapter in the whole. In another embodiment the circuit board 2, and optionally the electrically conducting element 4, and the electrically conducting retaining element 5 are contained in a holder or the like, which holder can be inserted into the hole.

Alternatively, the electrically conducting element 4 may be dispensed with such that the electrically conducting retaining element 5 is in direct contact with the supply circuit on the circuit board 2. As a further alternative the electrically conducting front layer 12 may extend over the electrically conducting retaining element 5 such that the electrically conducting front layer 12 keeps the electrically conducting retaining element 5 in place, for example when the electrically conducting front layer 12 has been prepared by extrusion for subsequent assembly into the composite board.

The second electrical connection to the electrically conducting rear layer 13 is formed from the second electrical terminal via a, preferably printed, conductor on the circuit board 2 extending to a conductor mounted on, in or through the circuit board 2. In the embodiment shown, the conductor extends through a hole in the circuit board 2 to the electrically conducting rear layer 13. The conductor may take the form of an electrically conducting pipe, a cable or a rod, etc.

The adapter is furthermore provided with a thermal conductor component 6, e.g. of silicon carbide, on which the LED 3 is mounted, further comprising thermal conductors 7, in the form of copper threads, extending between the thermal conductor component 6 and the electrically conducting back layer 13 through the circuit board 2. Other heat conducting materials may be used as well.

Additionally, as all the components/elements in the hole may be flush with the surface of the electrically conducting front layer 12, i.e. there are no protruding parts extending beyond the surface of electrically conducting front layer 12, an additional light processing layer 10 in the form of an acrylic plate or film is provided on top of the electrically conducting front layer 12. The light processing layer 10 may only cover the hole, for example if it is in the form of a recessed lens, or it may also be dispensed with. The light processing layer may be used for protecting the electronic component from water, e.g. together with a seal (not shown), and/or Ultra Violet (UV) light and/or scatter and/or diffuse and/or focus light emitted from the light emitting diode.

Further attachment means may be used to keep the adapter in place, such as an adhesive or paste that may be electrically conducting. Also an optical lens may be attached as the light processing layer 10 or be incorporated therein.

In the embodiment depicted in FIG. 2, the electrically conducting element has a base 41 and is provided with four conducting resilient legs 42 extending between the base 41 and an electrically conducting retaining element 5. Alternatively, the electrically conducting element 41 may be provided with an arbitrary number of legs such as three to six legs. FIG. 2 also shows a printed circuit 21 on the circuit board, e.g. in the form of an aluminium plate with a printed circuit. The aluminium secures a good thermal contact to the LED's thermal conductor component 6. The circuit board 2 is coated on the back side with a thin layer of gold to provide at good thermal and electrical contact to the bottom of the recess in the form of the electrically conducting rear layer 13. The gold coating may be dispensed with. The lighting fixture may also comprise, e.g. between the circuit board 2 and the electrically conducting back layer 13, a thermal paste to provide better thermal contact to thereby leading heat away from the LED and further to prevent corrosion of the electrically conducting back layer 13, e.g. when the electrically conducting back layer 13 is made from aluminium. When the lighting fixture comprises a thermal paste it may also comprise a thin toothed washer between the circuit board 2 and the electrically conducting back layer 13 in order to avoid electrical resistance from the thermal paste.

Figure 3:
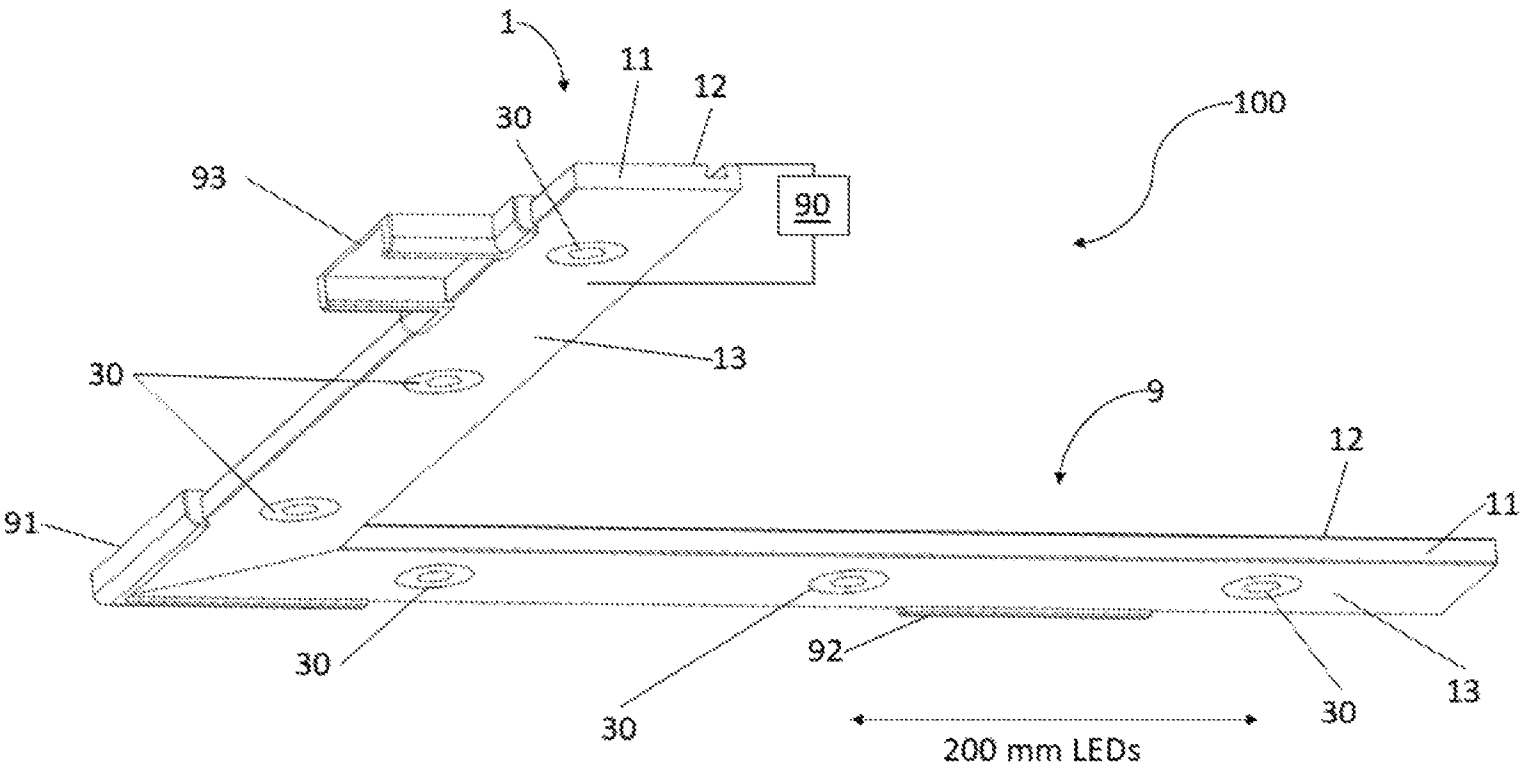
FIG. 3 shows the bottom view of an embodiment of a lighting fixture of the invention.
Figure 4:
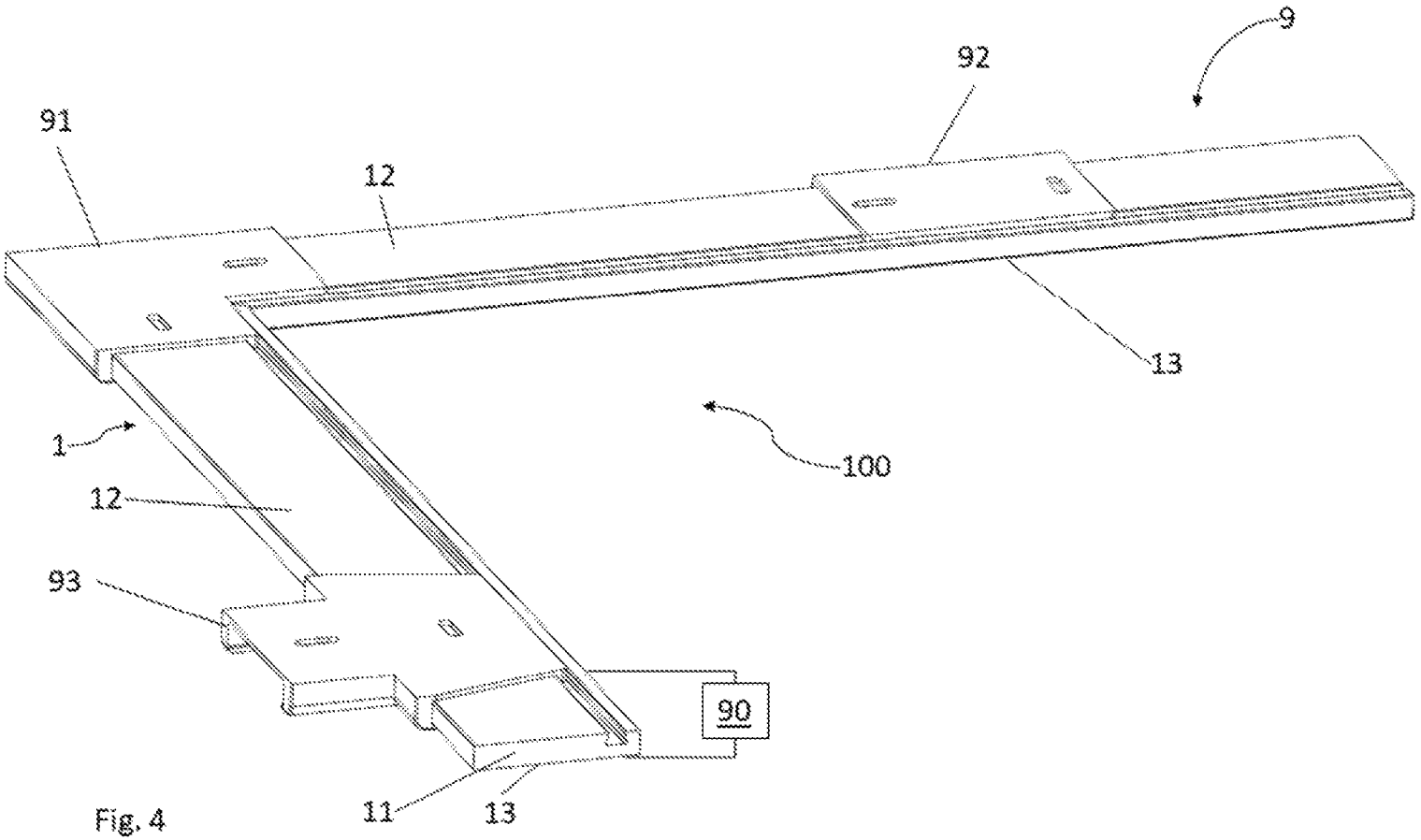
FIG. 4 shows the top view of an embodiment of a lighting fixture of the invention.

FIG. 3 and FIG. 4 show an embodiment of the lighting fixture connected to a supplementary module via a coupling device, a "corner bracket" 91. FIG. 3 and FIG. 4 also show a coupling device in the form of a "straight bracket" 92 that can couple two sections in a straight line, and further a "T-bracket" 93 is shown. In an embodiment of the invention the power supply to the lighting fixture is provided via the T-bracket 93, although a corner bracket 91 or a straight bracket 92 may also be used to supply power. The lighting fixture of FIG. 3 and FIG. 4 is for mounting under a kitchen cabinet and it has a composite board of 3 mm thickness and a width of 600 mm corresponding to the width of the kitchen cabinet. The length of the lighting fixture and any supplementary module may follow recognised standards. For example, for kitchen cabinets may have a standard width of 600 mm so that the length of the lighting fixture and/or the supplementary module will also be 600 mm. It is also possible for the length to a multiple of the standard value, e.g. 1200 mm or 1800 mm. Each adapter comprises 4 serially connected LEDs with a combined nominal Vf of about 11.6 V. The adapters are positioned at a distance from each other of 200 mm. The lighting fixture has been cut a 45° angle and is connected to a supplementary module that has likewise been cut at a 45° angle so that the connection via the corner bracket 91 provides a 90° angle between the lighting fixture and the supplementary module. The lighting fixture is supplied via a single 12 V constant voltage power supply.

Figure 5:
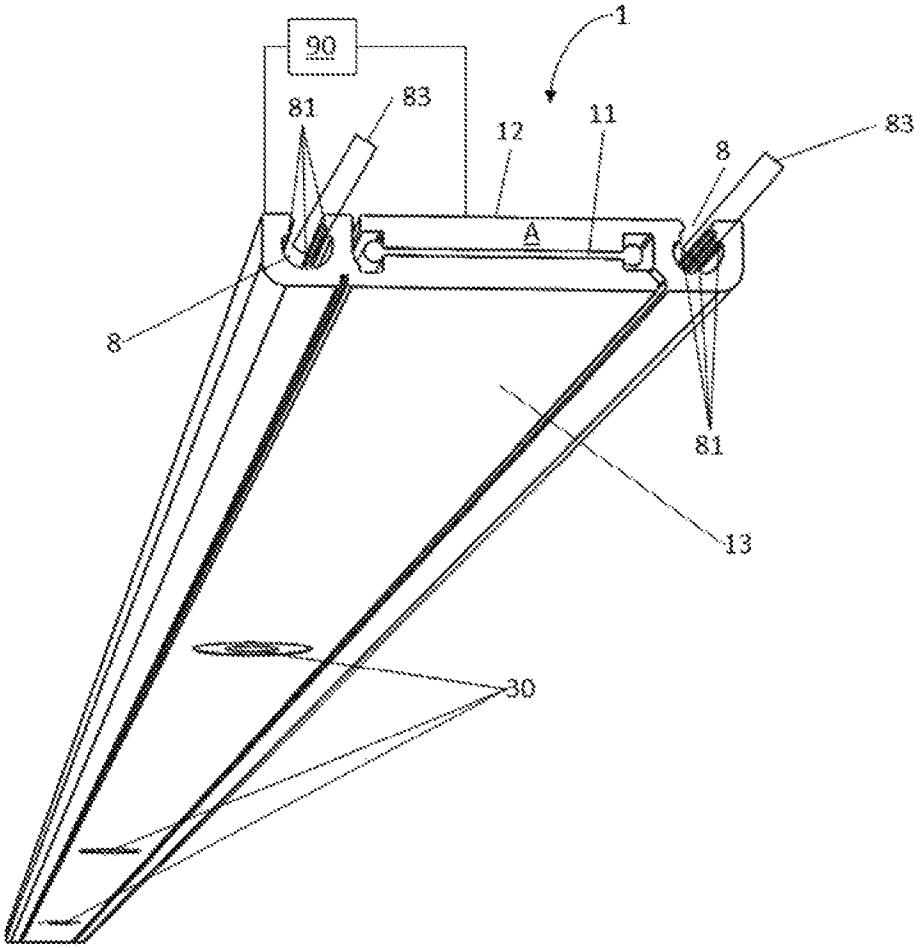
FIG. 5 shows a perspective view of an electric supply module of the invention.
Figure 6:
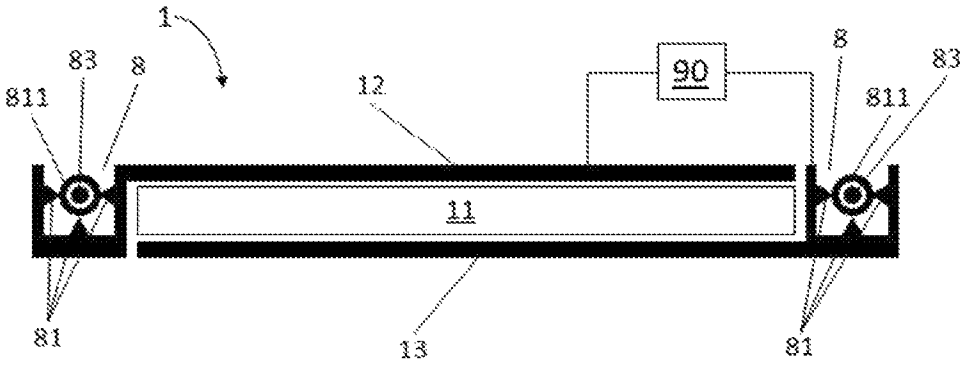
FIG. 6 shows an end view of an electric supply module of the invention.

A perspective view of an electric supply module 1 of the invention is illustrated in FIG. 5, and the connection surface of the electric supply module 1 is shown in FIG. 6. The composite board of the electric supply module 1 comprises an anode layer 12 and a cathode layer 13 of anodised aluminium. The electrically conducting layers 12,13 have been prepared by extrusion so that the electrically conducting layers 12,13 each comprise a trench 8 along the longitudinal axes of the electrically conducting layers 12,13 through the length of the respective layers. The electrically conducting layers 12,13 have been assembled with an insulator 11 of polyethylene. The electric supply module 1 shown in FIG. 5 comprises a plurality of adapters 30; in the embodiment of FIG. 5 the adapters comprise LEDs. The adapters are electrically connected in parallel in the electric supply module 1, which is fitted with a power supply 90 providing a constant voltage of 12 V. In another embodiment the constant voltage is 24 V. The electrically conducting layers 12,13 each have a trench 8 with three ridges 81 along the length axis of the trench 8. The trenches in FIG. 5 and FIG. 6 are open to a surface, e.g. the back surface, of the electrical supply module 1. In FIG. 5 the trenches 8 have a circular cross-section with the ridges 81 defining a circle in the plane of the cross-section. In FIG. 6 the trenches 8 have a rectangular, e.g. square, cross-section with a ridge 81 on each wall, so that the three ridges 81 in this case also define a circle in the plane of the cross-section. The connection surface A is in a plane, which is normal to the longitudinal axis of the electrically conducting layers 12,13, and the angle of the trenches 8 is normal to the same plane. FIG. 6 illustrates the electric supply module 1 seen from the connection surface A; the embodiment and its features depicted in FIG. 6 are not drawn to scale. Each trench 8 has a connection element 811 in the form of a hollow brass cylinder with an external helical thread (not shown). The brass cylinder has a diameter slightly larger than the circle defined by the tips of the three ridges 81 so that the brass cylinder can be screwed into the ridges 81 and penetrate the oxide layer thereby creating electrical connection from the respective electrically conducting layer 12 or 13 to the hollow part of the brass cylinder.

The electric supply module 1 is used with connector 83 having a first and a second complementary connection element allowing the electric supply module 1 to be connected with an extension module 9 of the invention. It is preferred that the electric supply module 1 and the extension module 9 have composite boards with trenches with identical connection elements so that these can be connected with a connector pin 83 e.g. a brass connector pin 83, having two identical complementary connection elements. The complementary connection elements may for example be banana connectors that can be inserted into the hollow part of the brass cylinders. However, in another embodiment the trenches of the electric supply module 1 have different connection elements from the trenches of the composite board of the extension module, and the connector pins 83 have correspondingly different complementary connection elements. In yet a further embodiment the anode layers 12 employ one type of connection elements and complementary connection elements, and the cathode layers 13 employ a different type of connection elements and complementary connection elements. In a particularly preferred embodiment, the anode layers 12 and the cathode layers 13 cannot be connected using the same type of connector pins 83 so that correct connection between the electric supply module 1 and an extension module 9 is ensured.

The connection surface A is depicted at the end of the electric supply module 1. However, the connection surface, or further connection surfaces, may be located along the side of the composite board. In an embodiment, the electrically conducting layers 12,13 are extruded from aluminium to each have a trench along the length of the electrically conducting layers 12,13, and further trenches can be provided at any location in the composite board in order to provide further connection surfaces, e.g. at a right angle to the longitudinal axis of the electrically conducting layers 12,13.

The invention claimed is:

1. An electrical supply module comprising:

a composite board comprising an anode layer and a cathode layer of electrically conducting material, which anode layer and cathode layer are separated by an insulator of electrically insulating material, the anode layer and the cathode layer each having a trench extending from a connection surface at an end of the composite board, an adapter for mounting in a hole extending entirely through or partly through the composite board, the adapter comprising a circuit board carrying an electronic component, the circuit board establishing electrical connection from the anode layer to an anode of the electronic component and electrical connection from the cathode layer to a cathode of the electronic component, and a power supply capable of providing a constant voltage or a constant current between the anode layer and the cathode layer.

2. The electrical supply module according to claim 1, wherein each trench comprises a connection element for engaging with a complementary connection element of a connector pin.

3. The electrical supply module according to claim 2, wherein the connection element is a hollow metallic cylinder with an outer helical thread.

4. The electrical supply module according to claim 1, wherein each trench comprises a ridge extending along a wall of the trench.

5. The electrical supply module according to claim 4, wherein the trench has at least three ridges extending along the length axis of the trench with the tips of the ridges being placed on the perimeter of a circle defined in a plane normal to the length axis of the trench.

6. The electrical supply module according to claim 1, wherein the electrically conducting material is a metal selected from the list consisting of aluminium, magnesium, copper, titanium, steel, and their alloys.

7. The electrical supply module according to claim 6, wherein the metal has been anodised.

8. The electrical supply module according to claim 6, wherein the anode layer and/or the cathode layer has been extruded from the metal.

9. The electrical supply module according to claim 1, wherein the electrical supply module comprises a plurality of adapters.

10. The electrical supply module according to claim 1, wherein the electronic component is selected from the list consisting of a light emitting diode (LED), a series of LEDs, a resistor, a transistor, a controller, a chip on board (COB), a driver, a microphone, a camera, a sensor, a radio transmitter, a radio receiver, an antenna and an access point for wireless communication.

11. The electrical supply module according to claim 1, wherein the electrical supply module comprises a plurality of adapters each comprising a light emitting diode (LED) or series of LEDs, and the power supply being capable of providing a constant voltage.

12. An electrical supply system comprising:

an electrical supply module comprising a composite board comprising an anode layer and a cathode layer of electrically conducting material, which anode layer and cathode layer are separated by an insulator of electrically insulating material, the anode layer and the cathode layer each having a trench extending from a connection surface at an end of the composite board, the trench comprising a connection element for engaging with a complementary connection element of a connector pin, an extension module comprising a composite board comprising an anode layer and a cathode layer of electrically conducting material, which anode layer and cathode layer are separated by an insulator of electrically insulating material, the anode layer and the cathode layer each having a trench extending from a connection surface of the composite board, the trench comprising a connection element for engaging with a complementary connection element of a connector pin, a power supply capable of providing a constant voltage or a constant current between the anode layer and the cathode layer of the electrical supply module, an adapter for mounting in a hole extending entirely through or partly through the composite board of the electrical supply module or the composite board of the extension module, the adapter comprising a circuit board carrying an electronic component, the circuit board establishing electrical connection from the anode layer to an anode of the electronic component and electrical connection from the cathode layer to a cathode of the electronic component, and a connector pin for each trench of the electrical supply module, each connector pin having a first complementary connection element for engaging the connection element of the trench of the composite board of the electrical supply module and a second complementary connection element for engaging the connection element of the trench of the composite board of the extension module.

13. The electrical supply system according to claim 12, wherein the complementary connection element of the connector pin comprises a spring or an elastic section.

14. The electrical supply system according to claim 12, wherein the connector pin comprises a flexible link between the first complementary connection element and the second complementary connection element.

15. The electrical supply system according to claim 12, wherein the connector pin comprises an electrically conducting material for providing electrical connection between the anode layers of the electrical supply module and the extension module or between the cathode layers of the electrical supply module and the extension module.

16. The electrical supply system according to claim 12, wherein the extension module comprises an adapter for mounting in a hole extending entirely through or partly through the composite board, the adapter comprising a circuit board carrying an electronic component, the circuit board establishing electrical connection from the anode layer to an anode of the electronic component and electrical connection from the cathode layer to a cathode of the electronic component.

17. The electrical supply system according to claim 12, wherein the connection element is a hollow metallic cylinder with an outer helical thread.

18. The electrical supply system according to claim 12, wherein each trench comprises a ridge extending along a wall of the trench.

19. The electrical supply system according to claim 18, wherein the trench has at least three ridges extending along the length axis of the trench with the tips of the ridges being placed on the perimeter of a circle defined in a plane normal to the length axis of the trench.

20. The electrical supply system according to claim 12, wherein the electrically conducting material is a metal selected from the list consisting of aluminium, magnesium, copper, titanium, steel, and their alloys.

21. The electrical supply system according to claim 20, wherein the metal has been anodised.

22. The electrical supply system according to claim 20, wherein the anode layer and/or the cathode layer has been extruded from the metal.

23. A method of producing an electrical supply module, the method comprising providing an electrical supply module comprising:

a composite board comprising an anode layer and a cathode layer of electrically conducting material, which anode layer and cathode layer are separated by an insulator of electrically insulating material, the anode layer and the cathode layer each having a trench extending from a connection surface at an end of the composite board, a plurality of adapters for mounting in a hole extending entirely through or partly through the composite board, the adapters comprising a circuit board carrying an electronic component, the circuit board establishing electrical connection from the anode layer to an anode of the electronic component and electrical connection from the cathode layer to a cathode of the electronic component, a power supply capable of providing a constant voltage or a constant current between the anode layer and the cathode layer, and removing a section of the composite board, the section containing one or more of the adapters, which removal leaves the circuit board of at least one adapter in electrical connection with the power supply.

* * * * *